United States Patent [19]

Kriwetz et al.

[11] Patent Number: 4,625,118

[45] Date of Patent: Nov. 25, 1986

[54] DEVICE FOR THE ELUTION AND METERING OF A RADIOACTIVE NUCLIDE

[75] Inventors: Gert Kriwetz, Graz; Karl Gärtner, Hall, both of Austria

[73] Assignee: Bender + Co. Gesellschaft mbH, Vienna, Austria

[21] Appl. No.: 640,965

[22] Filed: Aug. 15, 1984

[30] Foreign Application Priority Data

Aug. 17, 1983 [AT] Austria ..... 2948/83

[51] Int. Cl.[4] ..... G21G 4/00

[52] U.S. Cl. ..... 250/432 PD; 141/90

[58] Field of Search ..... 141/90; 250/430, 431, 250/432 PD; 423/250

[56] References Cited

U.S. PATENT DOCUMENTS 3,710,118 1/1973 Holgate et al. ..... 250/432 PD
3,997,784 12/1976 Picunko et al. ..... 250/432 PD X
4,472,299 9/1984 Weisner et al. ..... 250/432 PD X

FOREIGN PATENT DOCUMENTS 335578 3/1977 Austria .

*Primary Examiner*—Stephen Marcus

*Assistant Examiner*—Mark Thronson

*Attorney, Agent, or Firm*—Marmorek, Guttman & Rubenstein

[57] ABSTRACT

For the radiation-proof elution and metering of a radioactive nuclide from a nuclide generator into a stock ampoule, the generator located in a radiation-proof housing is connected, on the one hand, to a stock of liquid nuclide solvent and, on the other hand, to an aspiration and metering device, connected to a filling mechanism, for the eluate. The generator is then flushed through under program control with a predeterminable quantity of solvent and the eluate is transferred into an intermediate vessel of the aspiration device, whereupon a predetermined quantity of eluate is discharged by means of the metering device into the filling mechanism, in which this quantity is filled into a pierceable ampoule; the intermediate vessel, the aspiration and metering device and the filling mechanism are also accommodated in the radiation-proof housing, and the closure of the pierceable ampoule is moved into alignment with an orifice of the housing, through which orifice the particular quantity of eluate is taken out of the pierceable ampoule from outside the housing.

3 Claims, 1 Drawing Figure

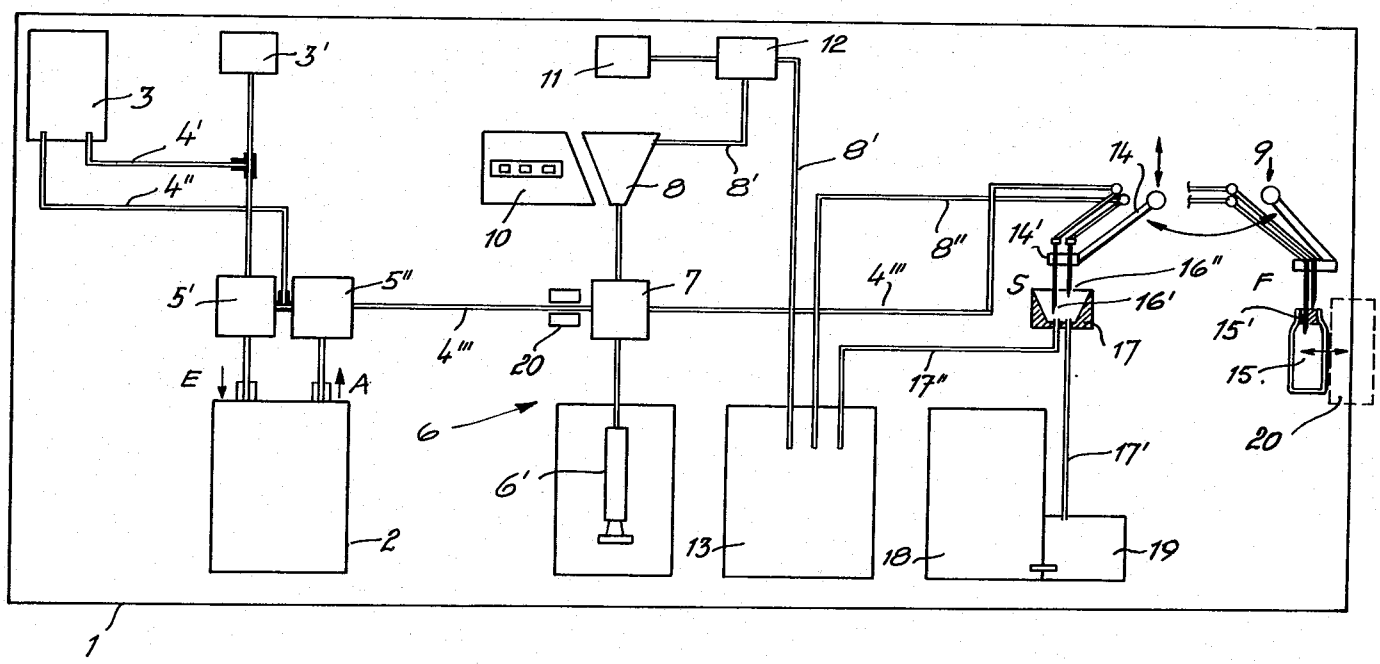
1
2
3
3'
4'
4"
4'''
5'
5"
6
6'
7
8
8'
8"
9
10
11
12
13
14
14'
15
15'
16'
16"
17
17'
17"
18
19
20
A
E
F
S

DEVICE FOR THE ELUTION AND METERING OF A RADIOACTIVE NUCLIDE

The invention relates to a process and device for the elution and metering of a radioactive nuclide, in particular technetium, from a nuclide generator into a stock ampoule or the like, from which the eluate is taken for use.

The current procedure on elution of the nuclide is that the generator is placed into a lead shielding and connected to an eluate vessel which contains an NaCl solution and with the aid of which the nuclide is eluted into an elution vessel likewise connected to the generator. In this way, it is possible, for example, to obtain a sterile solution of $^{99}Tc^{m}$ as sodium pertechnetate.

The lead-shielded elution vessel is then removed from the generator, and the solution obtained is taken from the vessel for use by means of a syringe. These steps carried out manually, however, involve the risk of the operator being exposed to radiation from the generator and from the eluate vessel. A device of the type described above is shown, for example, in No. AT-B-335,578.

It is therefore an object of the invention to provide a process and device for carrying out this process, which allow completely radiation-proof elution.

The invention relates to a process for the elution and metering of a radioactive nuclide, in particular of technetium, from a nuclide generator into a stock ampoule or the like, from which the nuclide is taken for use, the generator being located in a radiation-proof housing connected, on the one hand, to a supply of liquid nuclide solvent and, on the other hand, to an aspiration and metering device connected to a filling mechanism for the eluate; this process comprises flushing the generator under program control with a predeterminable quantity of solvent and transferring the eluate into an intermediate vessel of the aspiration device located within the radiation-proof housing, whereupon the radiation activity is measured and a predetermined quantity of eluate is discharged by means of the metering device located in the radiation-proof housing to the filling mechanism which is likewise provided in the radiation-proof housing and in which this quantity, is filled into a pierceable ampoule. The closure of the ampoule is moved into alignment with an orifice of the radiation-proof housing, through which orifice the particular quantity of eluate is taken out in the pierceable ampoule from outside the housing.

This working procedure has the result that the operator is not exposed to any radiation during and after the elution process, because all the process steps proceed fully automatically within an enclosed, radiation-shielded housing.

The invention also relates to a device for carrying out the process according to the invention, having a housing, shielded against radioactive radiation, for receiving a nuclide generator, a stock vessel for a liquid nuclide solvent, a mechanism for connecting the stock vessel to the generator inlet, a mechanism for connecting the stock vessel and the generator outlet to an aspiration and metering device for the eluate, which device is in turn connected to a filling station in which the eluate is filled into a stock ampoule or the like; the stock vessel for liquid nuclide solvent, the connecting mechanisms as well as the aspiration and metering device and the filling station all being located in the radiation-proof housing, and the aspiration and metering device having an aspiration syringe which can be connected via a controllable multi-way valve to an eluate stock vessel which is associated with a measuring instrument for measuring the radiation activity of the eluate, the aspiration and metering device and a flushing and disinfecting station associated with the filling station being connected to a waste container. A program control system for the program control of the entire elution process can be provided.

According to a preferred embodiment of the invention, the filling station has a swivel arm mechanism which carries a filling needle connected to the aspiration and metering device and a venting needle, and can be swivelled between a filling position and a flushing and disinfecting position, being displaceably mounted for filling and flushing.

Further features of the invention are explained in more detail below by reference to an illustrative embodiment of the device according to the invention, with reference to the accompanying diagrammatic drawing.

In a housing 1, which is shielded against radioactive radiation, a mounting (not shown) is provided for a nuclide generator 2, in particular technetium generator, the construction of which is known to those skilled in the art. A vessel 3 containing an NaCl solution or dilute hydrochloric acid is also placed into the housing and connected to the inlet E of the generator 2 via a hose line 4' in which a 3-way valve 5' is inserted. Moreover, an air filter 3' is connected to the line 4'. The vessel 3 containing the NaCl solution is also connected via a hose line 4'' and 3-way valve 5', inserted in this line, to the outlet of the generator 2. A further hose line 4''' runs from the valve 5'' to an aspiration and metering device generally indicated at 6. This device can be connected via a 4-way valve 7 to the valve 5', to an eluate stock vessel 8 and to an eluate filling station generally indicated at 9.

The eluate stock vessel 8 is associated with a measuring instrument 10 for determining the radiation activity of the eluate. The stock vessel 8 can be connected, on the one hand, via the valve 7 to the filling station 9 and, on the other hand, via a venting line 8' and a 3-way valve 12, connected to an air filter 11, to a waste container 13.

In the filling station 9, a swivel arm mechanism 14 or the like is provided for an eluate vessel 15, which is a pierceable ampoule or bottle in the example shown. The swivel arm 14 is mounted in such a way that it can be swivelled in the horizontal direction between a filling position F in the filling station 9 and a flushing and disinfecting position S in a flushing and disinfecting station 17 and can be displaced in the vertical direction. The lower end of the swivel arm 14 is provided with a carrier 14' for two needles 16' and 16''. One needle 16', the longer one, is connected to the valve 7, whereas the other needle 16'', the shorter one, is connected via a hose line 8'' to the waste container 13. The station 17 for flushing and disinfecting the needles 16' and 16'' is connected via a hose line 17' and a pump 19 to a stock vessel 18 for a disinfecting and flushing liquid, and is connected via a further line 17'' to the waste container 13. In the region of the filling station 9, a lock 20 for introducing and removing the eluate bottle 15 is provided in the wall of the housing 1.

Additionally, the device is provided with a program control system (not shown), for the program control of the entire working sequence. Such control systems are known to those skilled in the art and therefore will not be explained in more detail.

The device explained above operates as follows: after the nuclide generator 2 and the NaCl vessel 3 have been inserted into the housing 1 and the hose lines 4', 4'' have been connected to the generator 2, it being possible, for example, for these steps to take place automatically when the housing 1 is closed, the lines are first flushed free. For this purpose, after the program control system has been actuated the valve 5' is brought into a blocking position, and the valve 5'' is set in such a way that the vessel 3 is connected to the 4-way valve 7. The valve 7 in turn is set in such a way that it is connected to a syringe 6' located in the device 6, so that this syringe can aspirate the NaCl solution. The valve 12 is set in such a way that the stock vessel 8 is vented or can be flushed to the waste container 13. The valve 7 is then changed over for freeing the connection between the syringe 6' and the stock vessel 8, whereupon the syringe 6' forces the aspiration NaCl solution into the stock vessel 8, until the latter is filled. The valve 12 is then changed over, so that the stock vessel 8 is connected only to the air filter 11, whereupon the syringe 6' again aspirates the liquid from the stock vessel 8. The valve 7 then connects the syringe 6' to the needle 16', swivelled into the flushing position S, and the syringe 6' flushes the previously aspirated contents of the stock vessel 8 via the needle 16' and the line 17'' into the waste container 13.

The operator then sets the desired quantity of solution to be eluted on the control system. The program control is arranged in such a way that the valve 5' initially connects the NaCl vessel 3 to the inlet E of the generator 2 and the valve 5'' connects the outlet A of the generator to the valve 7 which makes the connection with the syringe 6'. The syringe 6' then aspirates, until the first drop of the eluate solution obtained appears at the syringe inlet; this is detected by a photoelectric barrier 20 in front of the valve 7. The valve 7 then changes over to connection between the syringe 6' and the flushing station 17, in which the swivel arm 14 with the needles 16' and 16'' is in the starting position, and the syringe 6' is emptied via the needle 16' and the line 17'' into the waste container 13. The valve 7 then changes again to connection between the outlet A of the generator 2 and the syringe 6', so that the predetermined quantity of solution can be aspirated, minus that quantity which is present in the lines between the valve 5', the generator 2 and the valve 5'' up to the inlet of the syringe 6'.

When the predetermined filling quantity has been reached, the syringe 6' stops and the valve 5' is changed over, so that the air filter 3' is connected to the generator inlet E. The syringe 6' then aspirates the residual volume and after the valve 12 has changed over the venting line 8' to connection to the waste container 13 forces it via the valve 7 into the stock vessel 8. The air filter 11 is then connected via the valve 12 to the stock vessel 8 for venting. By aspirating air several times by means of the syringe 6' via the valve 5', the generator 2, the valve 5'' and the valve 7, and expelling the air via the valve 7 and the flushing station 17, the generator 2 is dried.

The NaCl solution is aspirated by the syringe 6' via the valves 5'' and 7, until the inlet of the syringe 6' is reached, whereupon the syringe 6' is emptied into the flushing station 17. The desired quantity is then aspirated from the stock vessel 8, if desired with a further aspirated quantity of NaCl for dilution, and then forced up to the filling needles 16,16', in order to displace the air from the line 7'. By this time, the desired eluate bottle 15 has been moved, by means of a transport device which is not shown, into the filling station 9 and the bottle closure has been disinfected. The needles 16' and 16'', which have been moved into the filling station, are then moved in this station 9 downwards towards the bottle 15, until the first needle 16' pierces the rubber closure cap 15' of the bottle 15 and filling of the eluate by means of the syringe 6' starts. To release the excess pressure thus produced in the bottle 15, the needles 16' and 16'' are moved further downwards after a short filling period, so that the second needle 16'' also pierces the bottle closure and allows the air or nitrogen excess to escape via a line 12' into the waste container 13. After the bottle 15 has been filled, the needles 16' and 16'' are withdrawn from the closure and swivelled by means of the arm 14 into the flushing and disinfecting station 17 in order to be disinfected.

The filled bottle 15 is moved into a rotatable storage station, located in the housing 1 and not shown, and is stored until needed, in a cooled or warmed condition or at room temperature, as required.

To take out the eluate, the bottle 15, which is provided with lead shielding is moved into the lock 20, in which an orifice is provided, through which the required quantity can be withdrawn from the bottle 15 by means of an injection needle.

It is to be understood that the device illustrated can be modified in various ways within the scope of the general concept of the invention. Thus, for example, the aspiration syringe 6' of the aspiration and metering device can be replaced by a vacuum pump, but the latter must then be arranged at a place other than that shown. It would also be possible to replace the swivel arm mechanism by a different mechanical device. It is also to be understood that the entire elution process takes place under sterile conditions.

We claim:

1. A device for the elution and metering of a radioactive nuclide such as technetium, said device comprising a radiation-proof housing, said housing containing a nuclide generator having an inlet and an outlet, a first stock vessel for a liquid nuclide solvent, a second stock vessel for containing an eluate, a measuring instrument for measuring the radiation activity of the eluate in said second stock vessel, a mechanism for connecting said first stock vessel to said generator inlet, an aspiration and metering device for the eluate, a mechanism for connecting said first stock vessel and said generator outlet to said aspiration and metering device, a filling station, said aspiration and metering device being connected to said filling station in which the eluate is filled into an ampoule-like vessel, a controllable multi-way valve, a waste container, and a flushing and disinfecting station associated with said filling station and wherein said aspiration and metering device has an aspiration syringe, said syringe being connectable via said controllable multi-way valve to said second stock vessel, said aspiration and metering device and said flushing and disinfecting station associated with said filling station being connected to said waste container.

2. A device as claimed in claim 1, wherein said filling station has a swivel arm mechanism, a filling needle carried by said swivel arm mechanism and connected to said aspiration and metering device and a venting needle carried by said swivel arm mechanism, said swivel arm mechanism being swivellable between a filling position and a flushing and disinfecting position and being displaceably mounted for filling and flushing.

3. A device as claimed in claim 1, wherein said connecting mechanisms for connecting said stock vessel to the inlet of said generator has a controllable multi-way valve, through which said generator can be connected to the atmosphere.

* * * * *